US006310628B1

(12) United States Patent
Matsushita et al.

(10) Patent No.: US 6,310,628 B1
(45) Date of Patent: Oct. 30, 2001

(54) IMAGE DISPLAY DRIVE APPARATUS

(75) Inventors: Akihiro Matsushita, Isehara; Yukihiko Sakashita, Hadano, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/176,275

(22) Filed: Oct. 21, 1998

(30) Foreign Application Priority Data

Oct. 24, 1997 (JP) ..... 9-292471

(51) Int. Cl.[7] ..... G09G 5/34
(52) U.S. Cl. ..... 345/684; 345/87; 345/98
(58) Field of Search ..... 345/98, 100, 31, 345/56, 90, 684–687, 121, 123

(56) References Cited

U.S. PATENT DOCUMENTS 4,386,351 * 5/1983 Lowdenslager ..... 345/56
4,922,238 * 5/1990 Aoki et al. ..... 345/123
4,940,970 * 7/1990 Fujisaku ..... 345/28
5,021,772 * 6/1991 King et al. ..... 345/121
5,579,027 * 11/1996 Sakurai et al. ..... 345/100
5,729,245 * 3/1998 Gove et al. ..... 345/84
5,731,794 * 3/1998 Miyazawa ..... 345/88
5,903,260 * 5/1999 Imamura ..... 345/211
5,936,617 * 8/1999 Uchino et al. ..... 345/204

FOREIGN PATENT DOCUMENTS

11202841A * 7/1999 (JP) ..... G09G/3/36

* cited by examiner

*Primary Examiner*—Richard Hjerpe
*Assistant Examiner*—Alexander Eisen
(74) *Attorney, Agent, or Firm*—Fitzpatrick, Cella, Harper & Scinto

(57) ABSTRACT

An image display drive apparatus capable of shifting an image signal in the unit of one pixel in the horizontal direction of a display device such as a liquid crystal device whose plurality of pixels are driven at the same time. The image display drive apparatus for driving a plurality of pixels at the same time includes a signal processing circuit for supplying a plurality of pixel signals at the same time, delay circuits for delaying at least one of the plurality of pixel signals supplied from the signal processing circuit, and selectors for selecting image signals for driving pixels of the display device at the same time, from the outputs of the signal processing circuit and delay circuits, in accordance with a value of a select signal. In the image display drive apparatus, the signal processing circuit, delay circuits, and selectors are interconnected so that an image signal to the left by one pixel is selected as the select signal is incremented by 1.

8 Claims, 6 Drawing Sheets

DISPLAY DEVICE
109
V0'
V1'
V2'
V3'
105
106
107
108
2
SEL
MULTI-PLEXER
MULTI-PLEXER
MULTI-PLEXER
MULTI-PLEXER
VA
VB
VC
F.F.
F.F.
F.F.
102
103
104
V0
V1
V2
V3
IMAGE SIGNAL PROCESSING CIRCUIT
101

IMAGE DISPLAY DRIVE APPARATUS

BACKGROUND OF THE INVENTION

1. Field of the Invention

The present invention relates to an image display drive apparatus, and more particularly to an image display drive apparatus capable of sequentially driving a plurality of pixels two-dimensionally disposed on a display device.

2. Related Background Art

There is a method of driving a display device such as a liquid crystal display device having pixels disposed in a matrix shape, by driving a plurality of pixels at the same time, e.g., four pixels, two in the horizontal direction and two in the vertical direction. As compared to a method of driving pixels one pixel after another, the method of driving a plurality of pixels at the same time can provide a longer pixel drive time. Even a display device taking a long pixel drive time can display image signals of a high pixel frequency. As a means for shifting an image in the horizontal or vertical direction, there is a method of shifting the timings of a pixel drive signal relative to an image signal input to the display device.

With the above-described conventional method, however, since a plurality of pixels are driven at the same time, it is necessary to supply the display device with image signals for a plurality of pixels at the same time.

Therefore, with the method of changing the timing of a pixel drive signal relative to the image signal in order to shift image signals in the horizontal or vertical direction, the image signals can be shifted only in the unit of a plurality of pixels input at the same time.

SUMMARY OF THE INVENTION

It is an object of the present invention to provide an image display drive apparatus capable of shifting an image signal in the unit of one pixel in the horizontal and vertical directions, even for a display device such as a liquid crystal display whose plurality of pixels are driven at the same time.

In order to achieve the above object of the invention, the image display drive apparatus comprises signal processing means for outputting a plurality of pixel signals at the same time, delay means for delaying the pixel signal, and select means for selecting one of the pixel signals and delayed signals.

According to an embodiment of the invention, each time a select signal is cyclically incremented by 1, the select means selects (1) a signal corresponding to a pixel adjacent to a pixel in an image, (2) a signal corresponding to a left adjacent pixel in the image, or (3) a signal corresponding to an upper adjacent pixel in the image.

According to another embodiment of the invention, in order to drive a plurality of adjacent pixels at the same time, the image display drive apparatus has signal processing means for outputting a plurality of adjacent pixel signals at the same time, delay means for delaying at least one of the plurality of pixel signals output from the signal processing means, and select means for selecting pixel signals for driving the display device at the same time, from the outputs of the signal processing means and delay means.

According to another embodiment of the invention, in order to drive a plurality of pixels at the same time, the image display drive apparatus has signal processing means for outputting a plurality of pixel signals at the same time, delay means for delaying at least one of the plurality of pixel signals output from the signal processing means, select means for selecting pixel signals to be output from two or more multiplexers supplied with the outputs of the signal processing means and delay means, and a display device to be driven with the outputs of the two or more multiplexers at the same time.

DETAILED DESCRIPTION OF THE PREFERRED EMBODIMENTS

Figure 1:
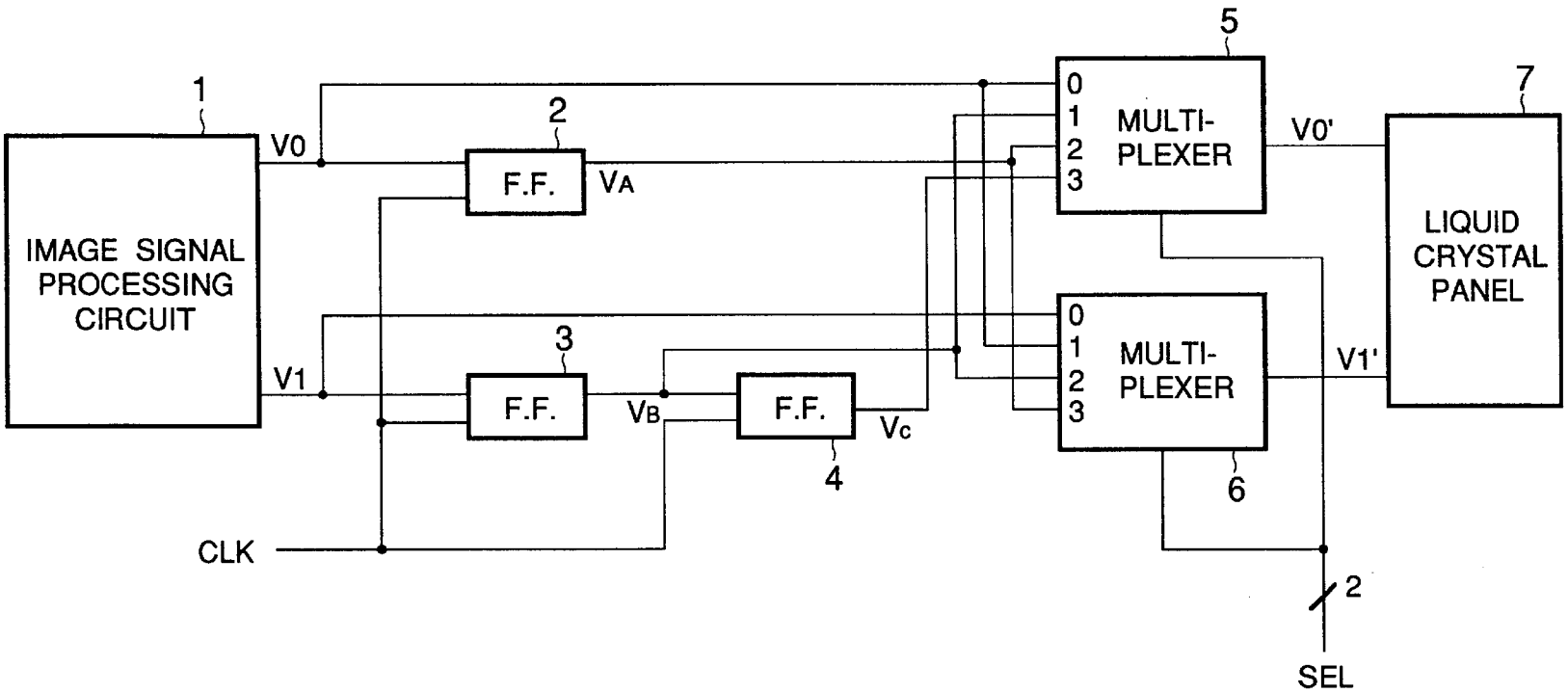
FIG. 1 is a block diagram showing an image display drive apparatus according to a first embodiment of the invention.

FIG. 1 is a block diagram showing an example of an image display drive apparatus according to the first embodiment of the invention. Referring to FIG. 1, image signals $V_0$ and $V_1$ output from an image signal processing circuit 1 are input to flip-flop circuits 2 and 3. An image signal $V_B$ output from the flip-flop circuit 3 is input to a flip-flop circuit 4. The image signals $V_0$ and $V_1$ and outputs $V_A$, $V_B$, and $V_C$ are input to multiplexers 5 and 6. Ones of the input signals are selected in response to a select signal SEL which cyclically takes predetermined values, and output from the multiplexers 5 and 6 as signals $V_0'$ and $V_1'$. These image signals $V_0'$ and $V_1'$ are input to a liquid crystal panel (display device) 7 of the type that two adjacent pixels in the horizontal direction are written at the same time.

Figure 2:
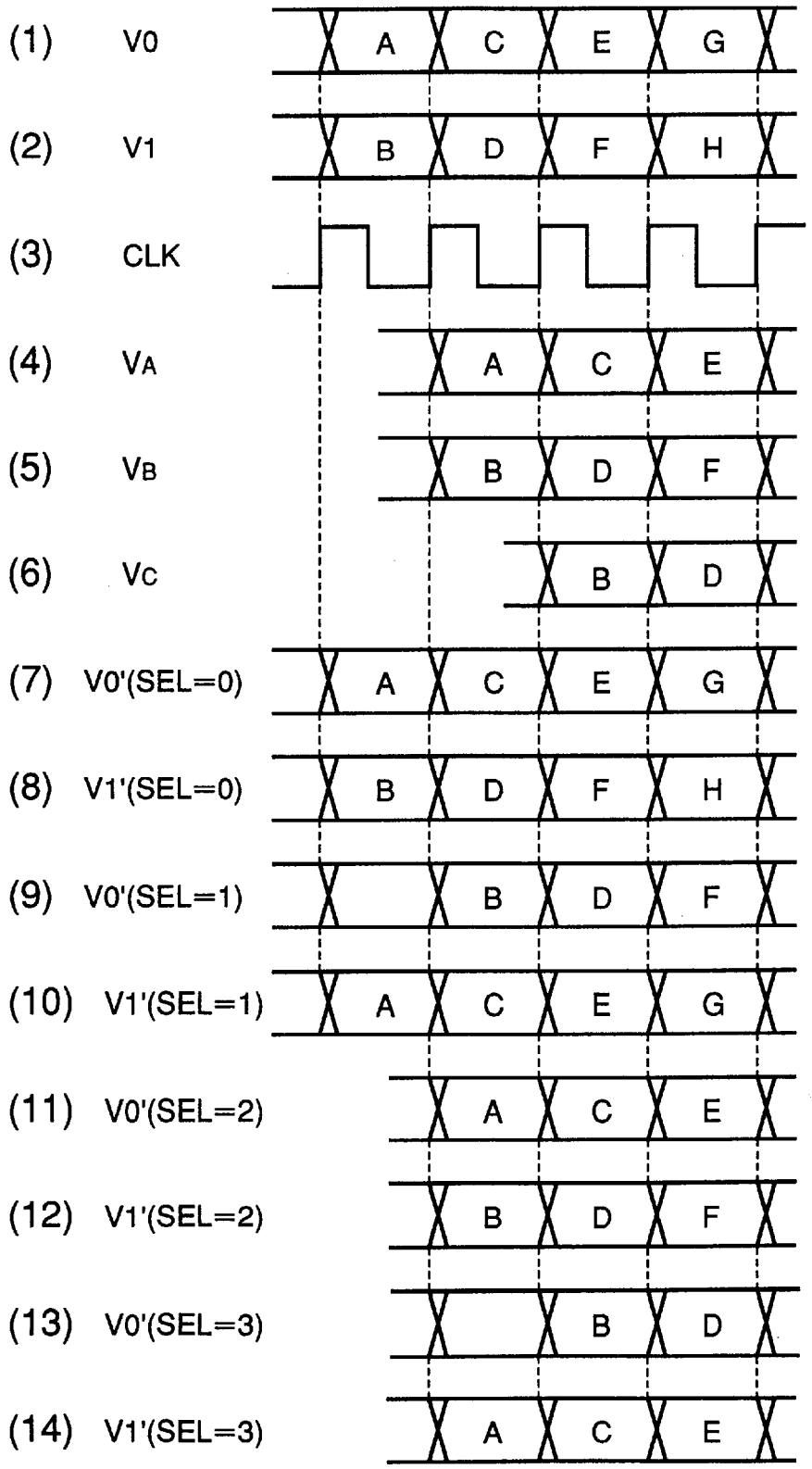
FIG. 2 is a timing chart of each image signal used in the circuit shown in FIG. 1.

Next, the operation of the image display drive apparatus will be described. FIG. 2 is a timing chart of each image signal $V_0$, $V_1$, $V_A$, $V_B$, $V_C$, $V_0'$, and $V_1'$. The image signals $V_0$ and $V_1$ are output from the image signal processing circuit 1 synchronously with a clock CLK. As shown in (1) and (2) in FIG. 2, A, C, E, . . . of the image signal $V_0$ are image signals different from B, D, F, . . . of the image signal $V_1$. The image signal $V_0$ delayed by one clock by the flip-flop circuit 2 is the image signal $V_A$. The timing of the image signal $V_A$ is shown in (4) in FIG. 2. Similarly, the timings of the image signals $V_B$ and $V_C$ are shown in (5) and (6) in FIG. 2.

The image signals $V_0$, $V_1$, $V_A$, $V_B$, and $V_C$ are input to the two multiplexers 5 and 6 as shown in FIG. 1. The select signal SEL is supplied to the multiplexers 5 and 6, and in accordance with the value of the select signal SEL, the outputs $V_0'$ and $V_1'$ of the two multiplexers 5 and 6 are selected from the input signals to the multiplexers 5 and 6.

If the select signal SEL=0, $V_0$ is selected as the image signal $V_0'$ whereas $V_1$ is selected as the image signal $V_1'$. The timings of the image signals $V_0'$ and $V_1'$ are shown in (7) and (8) in FIG. 2.

Figure 3:
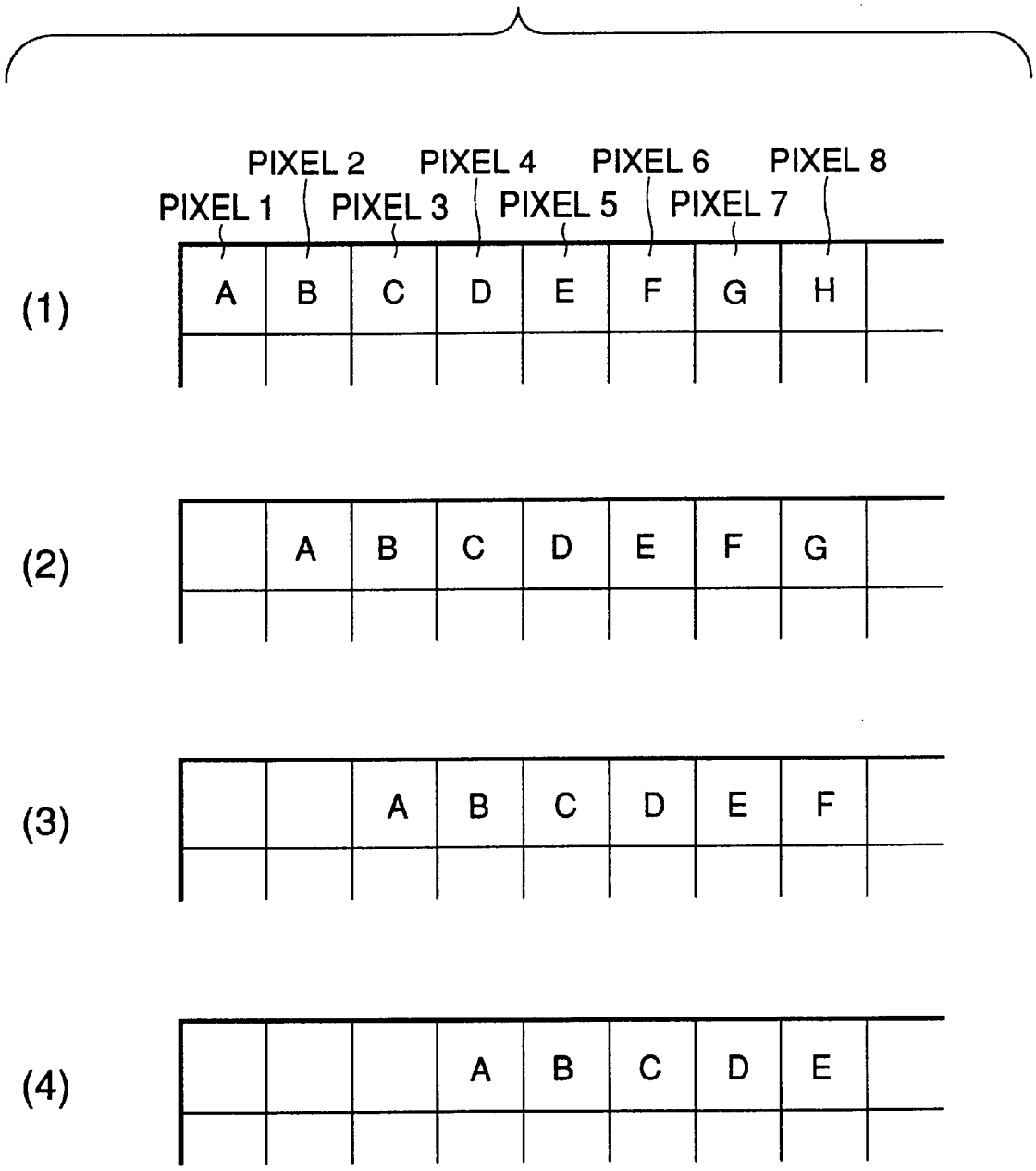
FIG. 3 shows images displayed on a display device according to the first embodiment and a second embodiment.

The image signals $V_0'$ and $V_1'$ are written in adjacent pixels of the liquid crystal panel 7. It is assumed as shown in (1) in FIG. 3 that the image signals are written in pixels in the order that the image signal A is written in the first pixel, image signal B is written in the second pixel, and so on.

If the select signal SEL=1, $V_B$ is selected as the image signal $V_0'$ whereas $V_0$ is selected as the image signal $V_1'$. The timings of the image signals $V_0'$ and $V_1'$ are shown in (9) and (10) in FIG. 2. The position of the pixel of the liquid crystal panel 7 into which the image signal is written becomes as shown in (2) in FIG. 3 to shift the image signal to the right by one pixel as compared to the select signal SEL=0.

If the select signal SEL=2, the timings of the image signals $V_0'$ and $V_1'$ are shown in (11) and (12) in FIG. 2. The position of the pixel into which the image signal is written becomes as shown in (3) in FIG. 3 to shift the image signal to the right by two pixels as compared to the select signal SEL=0.

If the select signal SEL=3, the timings of the image signals $V_0'$ and $V_1'$ become as shown in (13) and (14) in FIG. 2. The position of the pixel into which the image signal is written becomes as shown in (4) in FIG. 3 to shift the image signal to the right by three pixels as compared to the select signal SEL=0.

As above, it is possible to shift an image in the unit of one pixel for the image display of the liquid crystal panel 7 of the type that image signals can be written at the same time in adjacent two pixels in the horizontal direction.

With the configuration of the first embodiment, it is possible to provide an image display drive apparatus capable of shifting an image in the unit of one pixel unit along the horizontal direction, for the image display of the liquid crystal panel 7 of the type that image signals can be written at the same time in adjacent two pixels in the horizontal direction.

In the second embodiment of this invention, driving a display device (liquid crystal panel) of the type that image signals are written at the same time in adjacent four pixels in the horizontal direction will be described.

Figure 4:
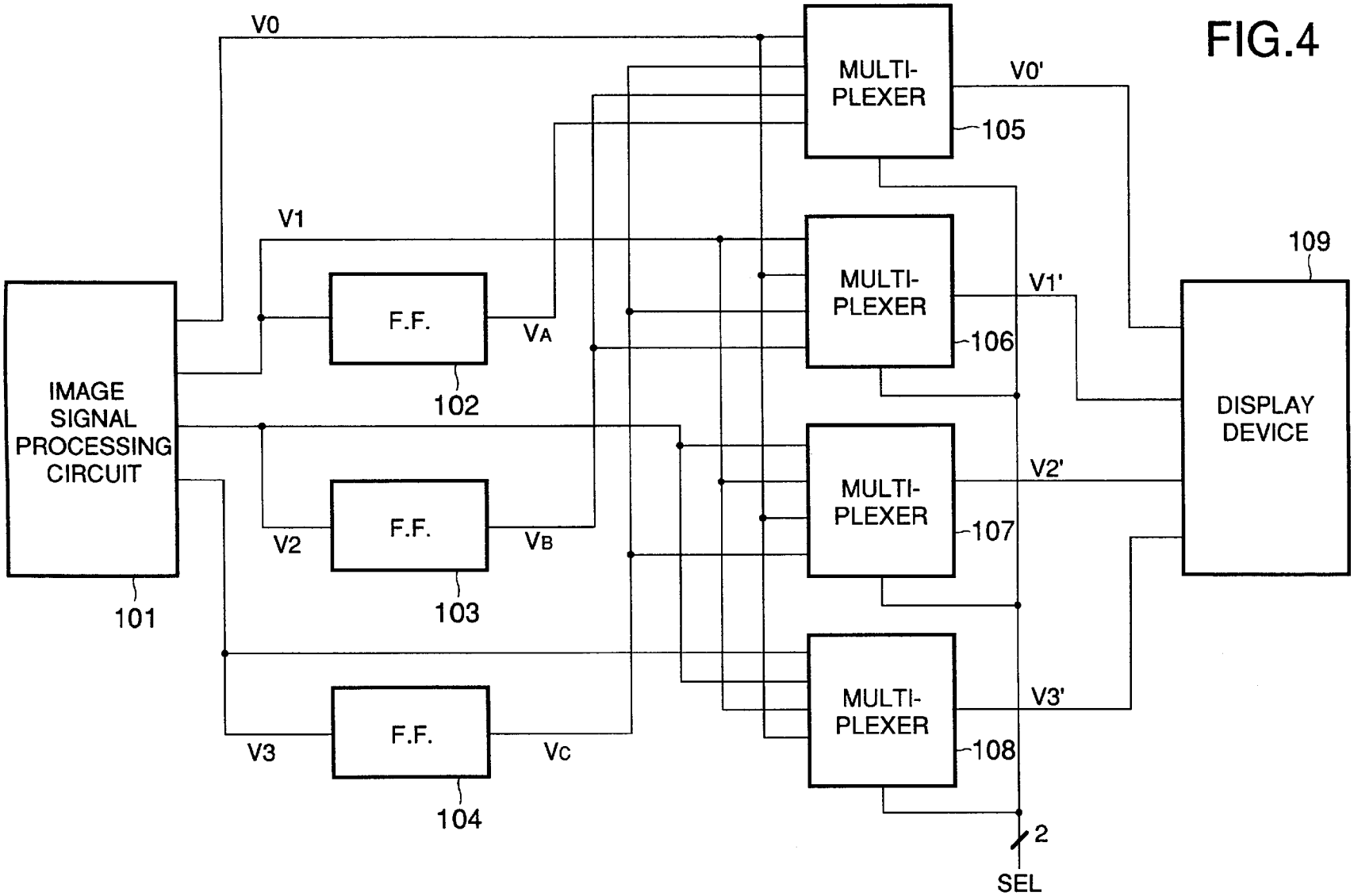
FIG. 4 is a block diagram showing an image display drive apparatus according to the second embodiment of the invention.

FIG. 4 is a block diagram of an Image display drive apparatus of the second embodiment. Referring to FIG. 4, image signals $V_0$, $V_1$, $V_2$, and $V_3$ corresponding to adjacent four pixels in the horizontal direction are output from an image signal processing circuit 101. The image signals $V_1$, $V_2$, and $V_3$ are input to flip-flop circuits 102, 103, and 104 which output image signals $V_A$, $V_B$, and $V_C$.

The image signals $V_0$, $V_1$, $V_2$, $V_3$, $V_A$, $V_B$, and $V_C$ are input to four multiplexers 105, 106, 107, and 108. Ones of the input signals to the multiplexers are selected in accordance with a value of a select signal SEL, and output from the multiplexers 105 to 108 as image signals $V_0'$, $V_1'$, $V_2'$, and $V_3'$. The select signal SEL cyclically takes predetermined values, e.g., from 0 to 3, and is used for selecting a desired image signal from each multiplexer circuit.

The output image signals $V_0'$, $V_1'$, $V_2'$, and $V_3'$ are input to a display device 109 to display an image, the display device being of the type that four adjacent pixels in the horizontal direction are written at the same time.

Figure 5:
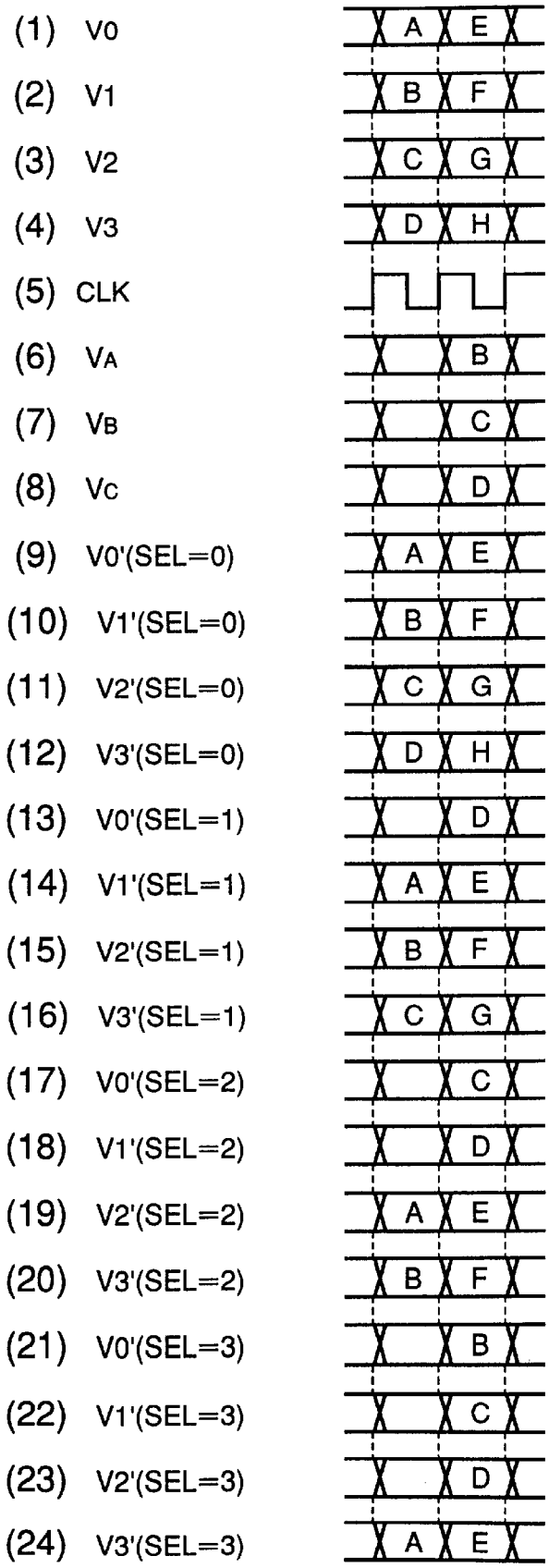
FIG. 5 is a timing chart of each image signal used in the circuit shown in FIG. 4.

Next, the operation of the image display drive apparatus of the second embodiment will be described. FIG. 5 is a timing chart of each image signal.

The image signals $V_0$, $V_1$, $V_2$, and $V_3$ output from the image signal processing circuit 101 are assumed to be output at the timings shown in (1), (2), (3) and (4) in FIG. 5. Since the image signals $V_1$, $V_2$, and $V_3$ delayed by one clock are the image signals $V_A$, $V_B$, and $V_C$, the latter image signals take the timings shown in (6), (7) and (8) in FIG. 5.

If the select signal SEL=0, it becomes that the image signals $V_0'=V_0$, $V_1'=V_1$, $V_2'=V_2$, and $V_3'=V_3$. The image signals $V_0'$, $V_1'$, $V_2'$, and $V_3'$ take the timings shown in (9) to (12) in FIG. 5. It is assumed that the image signals are written in pixels in the order as shown in (1) in FIG. 3.

If the select signal SEL=1, it becomes that the image signals $V_0'=V_C$, $V_1'=V_0$, $V_2'=V_1$, and $V_3'=V_2$. The image signals $V_0'$, $V_1'$, $V_2'$, and $V_3'$ take the timings shown in (13) to (16) in FIG. 5. The image signals are written in pixels in the order as shown in (2) in FIG. 3 to shift the image signal to the right by one pixel as compared to the select signal SEL=0.

Similarly, if the select signal SEL=2, the timings of the video signals $V_0'$, $V_1'$, $V_2'$, and $V_3'$ become as shown in (17) to (20) in FIG. 5. The image signals are written in the order as shown in (3) in FIG. 3 to shift the image signal to the right by two pixels as compared to the select signal SEL=0.

Similarly, if the select signal SEL=3, the timings of the video signals $V_0'$, $V_1'$, $V_2'$, and $V_3'$ become as shown (21) to (24) in FIG. 5. The image signals are written in the order as shown in (4) in FIG. 3 to shift the image signal to the right by three pixels as compared to the select signal SEL=0.

As above, it is possible to shift an image on the basis of one pixel unit, for the display unit of the type that image signals can be written at the same time in adjacent four pixels in the horizontal direction.

In the first and second embodiments, a display device of the type that adjacent two or four pixels in the horizontal direction can be driven at the same time, has been described. The embodiments are also applicable to a display device of the type that a desired number of pixels can be driven at the same time.

In the first and second embodiments, driving a plurality of pixels in the horizontal direction at the same time has been described. If a plurality of pixels in the vertical direction are to be driven at the same time, the components of the image display drive apparatus of the embodiments are connected in parallel. Specifically, in the circuits shown in FIGS. 1 and 4, adjacent image signals in the vertical direction are output from the image signal processing circuit 1, 101 in response to a vertical scan signal, and the flip-flop circuits and multiplexers are configured in the same manner as the first and second embodiments. In accordance with the value of the select signal SEL, the image signals are output from the multiplexers at the timing of the vertical scan signal to thereby drive a plurality of pixels in the vertical direction.

Also in the first and second embodiments, the apparatus capable of shifting by 0 to 3 pixels has been described. The amount of shift may be set as desired through an addition or combination of flip-flop circuits as delay means and multiplexers as select means.

The number of multiplexers as select means is the same as the number of pixels driven at the same time, and the number of flip-flop circuits as delay means is the same as the amount of necessary shifts. In order to shift image data, it is therefore necessary to prepare at least pixel select means equal to or the same as the number of pixel terminals driven at the same time and at least delay means equal to or the same as the amount of necessary shifts.

Figure 6:
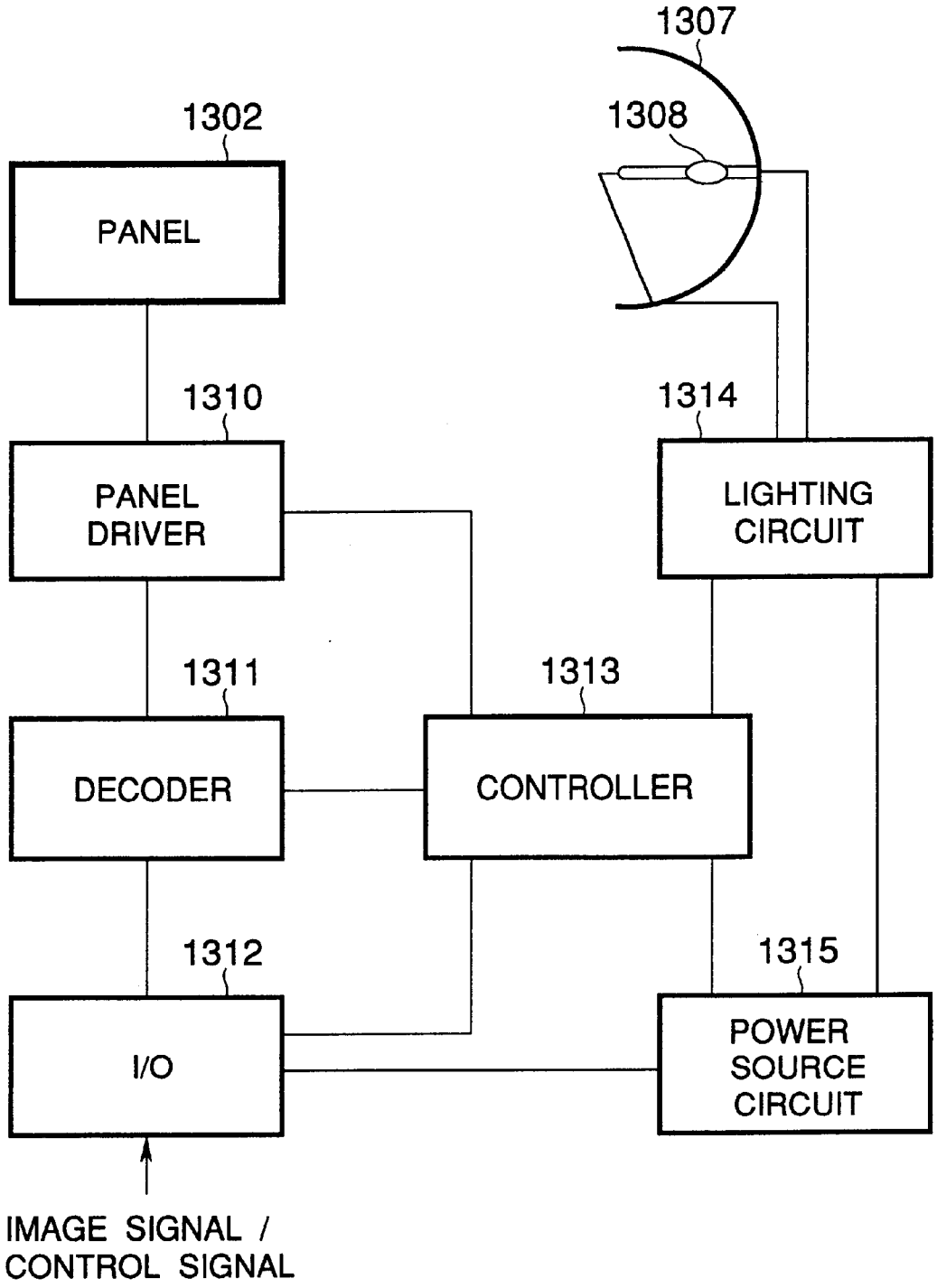
FIG. 6 is a block diagram of a liquid crystal display apparatus of the invention.

Next, an image processing apparatus according to a third embodiment will be described. The image processing apparatus includes the image display drive apparatus with the liquid crystal panel of the first or second embodiment and its peripheral circuits. FIG. 6 is a block diagram showing the overall structure of a drive circuit system for the liquid crystal display device of the image processing apparatus. Referring to FIG. 6, reference numeral 1310 represents a panel driver which includes the image signal processing circuit, delay means, and select means. The panel driver 1310 generates liquid crystal drive signals, other drive signals, and timing signals, the liquid crystal drive signals being generated by inverting the polarities of RGB image signals and voltage-amplifying the RGB image signals. The panel driver 1310 drives a plurality of lines of a high precision, high density liquid crystal panel 1302 at the same time. Reference numeral 1312 represents an I/O interface for decoding various image signals and transmission control signals into standard image signals and the like. Reference numeral 1311 represents a decoder for decoding the standard image signal supplied from the interface 1312 into RGB primary color image signals and sync signals matching the liquid crystal panel 1302. Reference numeral 1314 represents a lighting circuit serving as a ballast which drives and turns on an arc lamp 1308 mounted on an ellipsoidal reflector 1307. Reference numeral 1315 represents a power source circuit for supplying power to respective circuit blocks. Reference numeral 1313 represents a controller including an unrepresented control console which collectively controls the respective circuit blocks. The above-described drive circuit system for the liquid crystal display device functions as a single panel projector by using the first or second embodiment without any additional circuit blocks, and a color image of high quality and performance can be displayed on a high density liquid crystal panel.

As described so far, according to the present invention, the image display drive apparatus is provided between an image signal processing circuit and a display device for driving a plurality of pixels at the same time. It is therefore possible to shift an image in the unit of one pixel in the horizontal and vertical directions. The image display drive apparatus is constituted of delay circuits and selector circuits. More specifically, the image display drive apparatus is constituted of flip-flop circuits as delay means and multiplexers as select means using a select signal.

What is claimed is:

1. An image display drive apparatus for driving a display device having a plurality of pixels, comprising:

signal processing means for simultaneously supplying pixel signals to a plurality of adjacent pixels;

delay means for delaying at least one of the pixel signals outputted from said signal processing means; and selecting means for inputting the pixels signals outputted from said signal processing means and the pixel signal or signals delayed by said delay means and for selecting an output responsive to a select signal according to a shift quantity of a desired display image, thereby driving the plurality of pixels adjacent to each other of the display device, wherein the select signal takes on a configuration from among 0~N−1th possible configurations (where N is a natural number, i.e., a number of times of the simultaneous drivings), the configuration changing cyclically according to an instruction signal in a manner such that the select signal takes a first pixel signal when the configuration is a first configuration, and the select signal takes a display image signal distant by M pixels in a predetermined direction from the first pixel when the configuration is an M-th configuration (where M is a natural number meeting a condition: $0 \leqq M \leqq N-1$).

2. An image display drive apparatus according to claim 1, wherein the predetermined direction is left.

3. An image display drive apparatus according to claim 1, wherein the predetermined direction is up.

4. An image display drive apparatus according to claim 1, wherein said select means is provided with a multiplexer to which is input the image signal supplied from said signal processing means and the image signal delayed by said delay means, said plural pixels of said display device being driven simultaneously according to two or more image signals output from said multiplexer.

5. An image display drive apparatus according to claim 1, wherein said signal processing means supplies two pixel signals for driving simultaneously two pixels, said delay means is provided with a flip-flop inputting and delaying the two pixel signals, said select means is provided with two multiplexers inputting respectively the two pixel signals output from said signal processing means and the two pixel signals delayed by said flip-flop, outputs are selected from said two multiplexers in four configurations, and the selected outputs are used for driving simultaneously the two pixels of said display device.

6. An image display drive apparatus according to claim 1, further comprising:

a panel driver for driving a liquid crystal panel with a liquid crystal drive signal which is generated by inverting polarities of RGB image signals and voltage-amplifying the RGB image signals;

an interface for decoding various image and control signals into standard image signals;

a decoder for decoding the standard image signals supplied from said interface into the image signal corresponding to the RGB primary color image signals and sync signals;

a lighting circuit for driving and lighting a light source on; and a controller for collectively controlling said panel driver, said interface, said decoder, and said lighting circuit.

7. An image display drive apparatus according to claim 1, wherein the predetermined direction is right.

8. An image display drive apparatus according to claim 1, wherein the predetermined direction is down.

* * * * *

UNITED STATES PATENT AND TRADEMARK OFFICE

CERTIFICATE OF CORRECTION

PATENT NO. : 6,310,628 B1
DATED : October 30, 2001
INVENTOR(S) : Akihiro Matsushita et al.

It is certified that error appears in the above-identified patent and that said Letters Patent is hereby corrected as shown below:

Title page,
FOREIGN PATENT DOCUMENTS "11202841A" should read -- 11-202841A --.

Column 3,
Line 37, "Image" should read -- image --.

Column 5,
Line 44, "pixels" should read -- pixel --.

Signed and Sealed this

Twenty-first Day of May, 2002

*Attest:*

*Attesting Officer*

JAMES E. ROGAN
*Director of the United States Patent and Trademark Office*